United States Patent [19]

Earls et al.

[11] 4,073,133

[45] Feb. 14, 1978

[54] ELECTRONIC CHIME AND STRIKE SYSTEM

[75] Inventors: David E. Earls, Norwalk; C. N. Damodaran Nampoothiri, Stamford, both of Conn.

[73] Assignee: General Time Corporation, Thomaston, Conn.

[21] Appl. No.: 676,485

[22] Filed: Apr. 13, 1976

[51] Int. Cl.[2] ..... G04C 21/04; G04C 21/16

[52] U.S. Cl. ..... 58/13; 340/384 E

[58] Field of Search ..... 58/12, 13, 14, 21.12, 58/23 R, 38, 39.5, 126 C, 130 E; 340/331, 384 E, 392, 393

[56] References Cited

U.S. PATENT DOCUMENTS

| | | | |
|---|---|---|---|
| 2,582,441 | 1/1952 | Kunz | 340/384 R |
| 2,761,127 | 8/1956 | Miessner | 340/384 |
| 2,791,146 | 5/1957 | Kunz | 84/405 |
| 2,915,872 | 12/1959 | Maas | 58/38 |
| 3,623,086 | 11/1971 | Cronin | 340/384 E |
| 3,759,029 | 9/1973 | Komaki | 58/38 |

*Primary Examiner*—E. S. Jackmon

*Attorney, Agent, or Firm*—Pennie & Edmonds

[57] ABSTRACT

An electronic system having a chime and strike program simulating the program of a Westminster clock including an actuating source, a solid state integrated circuit and a loud speaker. The integrated circuit includes a plurality of counters for activating a frequency synthesizer and both tone switching and generating circuits thereby to generate the strike and chime program on the hour and a chime program on the other quarter hours indicative of the time throughout a 24-hour period. The chime program is sequenced by a chime matrix.

17 Claims, 15 Drawing Figures

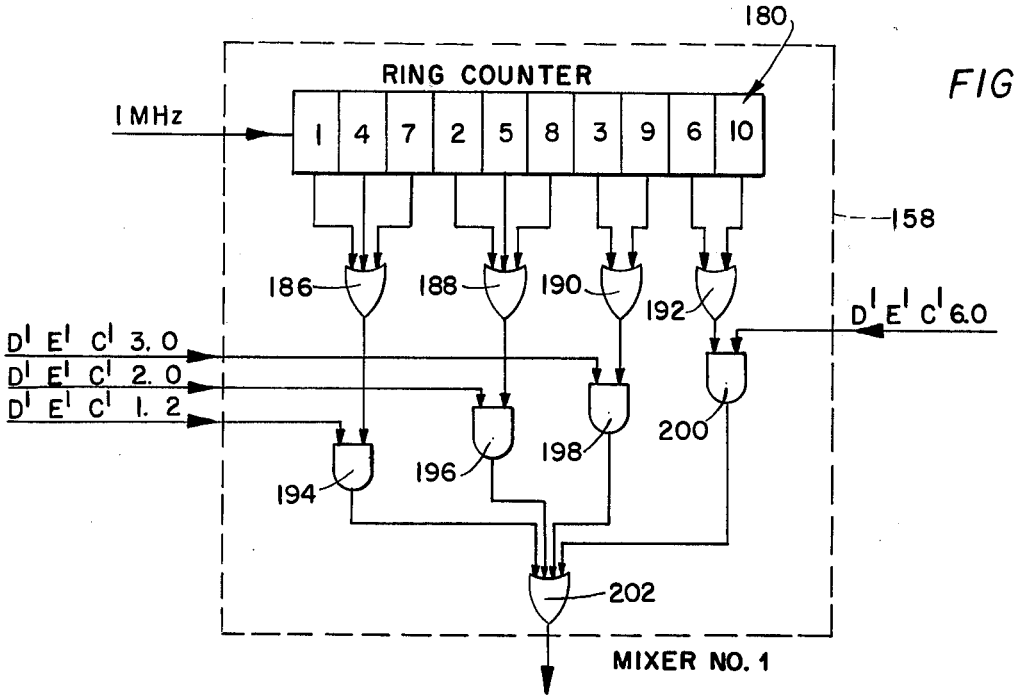
FIG. 7.
FIG. 8.
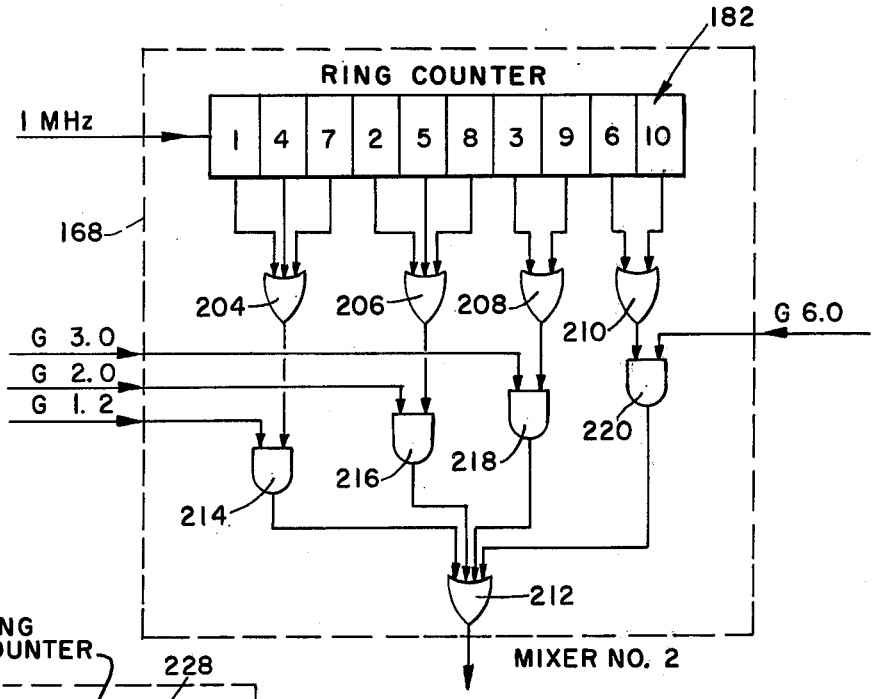
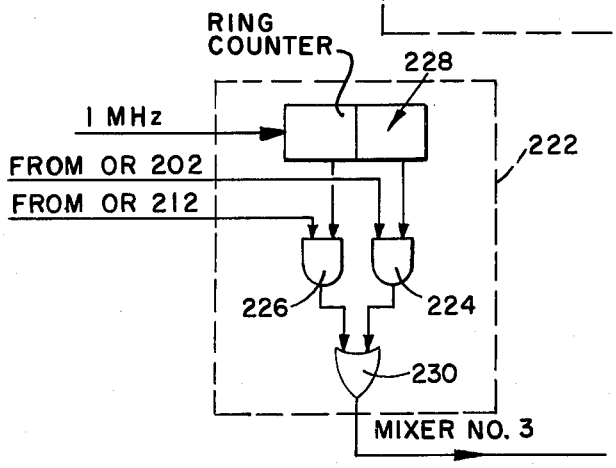
FIG. 9.

ELECTRONIC CHIME AND STRIKE SYSTEM

BACKGROUND OF THE INVENTION

Clocks including Westminster or other chime and strike programs are known in the prior art. Such clocks utilize a plurality of tone bars and a number of strikers which may be either mechanically or electrically actuated at the desired time interval to generate the particular program indicative of the interval. Chimes of the described type have tone qualities which are quite good and a sound which is pleasing. These features in part enhance the appeal of the clock with which the strike and chime program is a part. One disadvantage, however, is with regard to the lack of wide-spread commercial appeal to all segments of the consuming public primarily because of the higher cost of the clock with chime capability. This is because the costs of mechanical structures are increasing at a rapid rate.

Therefore, there has been the thought and attempts have been made to the end of producing an electronic alarm signal having tone qualities similar to a chime or bell. Representative of such an alarm is the form of alarm employing a chime alarm including an oscillator energized by a source through closure of a switch at a desired alarm time. Very generally, in this type of structure the sound is generated by the oscillation of a vibrating reed within the chime alarm, which oscillations are transduced, amplified and reproduced.

SUMMARY OF THE INVENTION

It is an object of the present invention to provide an electronic system for development of a simulated Westminster chime and strike program at quarter hour intervals and upon the hour during a 24-hour period, which system constitutes a marked departure from the type of system referred to above. The electronic system of the present invention provides the fundamental notes of each program with a harmonic content, modulated tone, exponential decay and a "vibrato effect" which simulates the musical timbre of a conventional strike and chime program of a clock having hammers and tone bars.

Briefly, the object and others as will become clear through a reading of the present specification are achieved according to one embodiment thereof, by providing a frequency synthesizer and tone switching and generating circuits which are activated by action of a plurality of counters and switching circuits for staging whereby a chime matrix provides sequentially outputs to the frequency synthesizer for a chime program and from a second source a further input to the frequency synthesizer results in a strike program.

BRIEF DESCRIPTION OF THE DRAWING

The subject of the present invention is particularly pointed out and distinctly claimed in the concluding portion of the specification. For a complete understanding of the present invention together with further objects and advantages thereof, reference should be made to the following description taken in conjunction with the accompanying drawing in which:

FIGS. 7–9 are diagrams of the digital mixers (1, 2 and 3, respectively) of the circuit of FIG. 4;

DESCRIPTION OF THE PREFERRED EMBODIMENT

Figure 1:
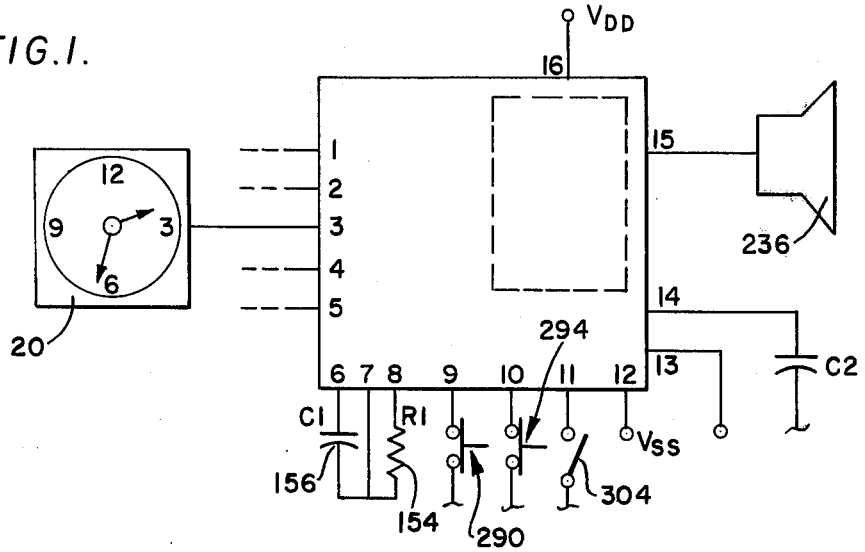
FIG. 1 is a simplified schematic illustration of the electronic system including an activating source, a solid state integrated circuit and a loud speaker.

Referring now to the drawing and particularly to FIG. 1 thereof, there is illustrated a simplified schematic diagram of the system of the present invention including a source of a pulsed electrical output signal, a strike and chime circuit which may be in the form of a solid state integrated circuit and a dynamic loud speaker which sounds a Westminster chime program after each quarter hour interval and upon the hour followed by a strike program including the requisite number of strikes indicative of that hour throughout each 24-hour period.

Figure 2:
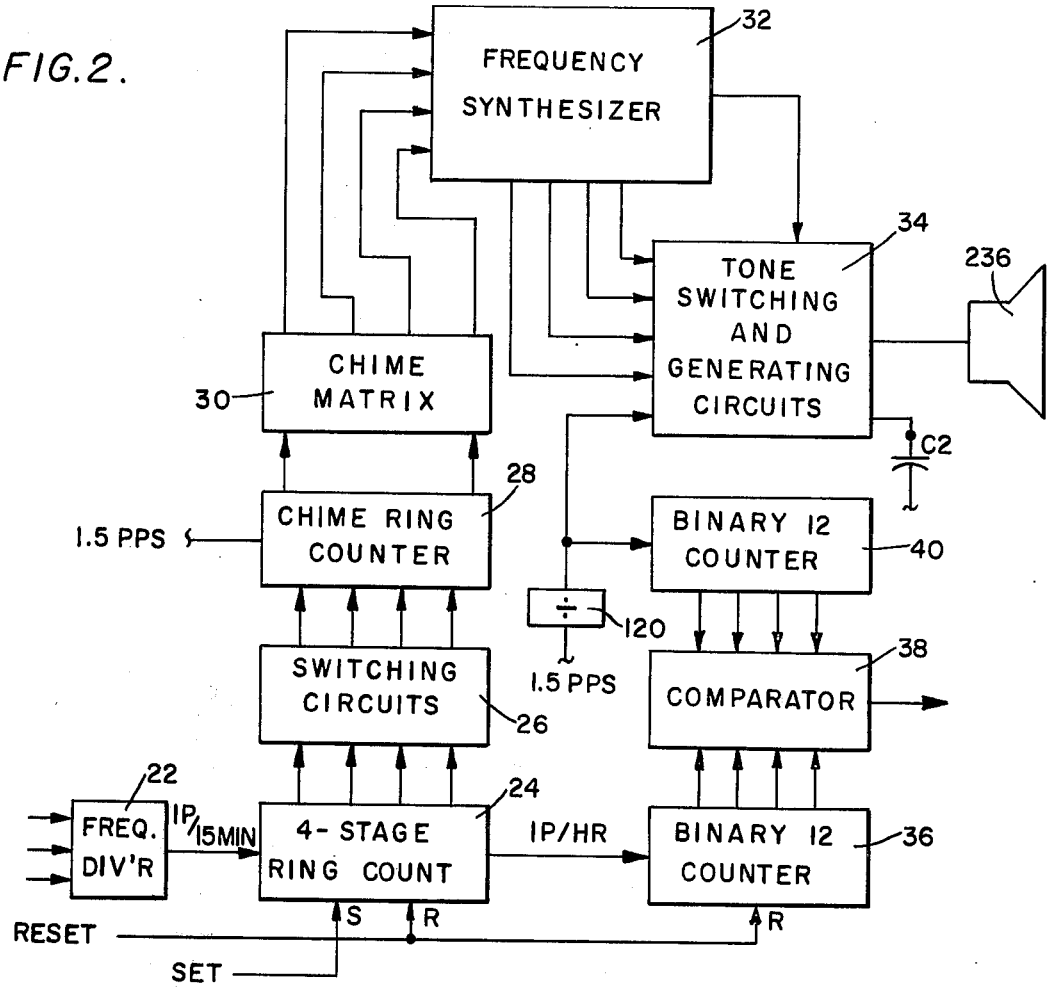
FIG. 2 is a block diagram of the major subcomponents of the solid state integrated circuit of FIG. 1.

Typical of one source of power may be a battery clock movement 20 providing an electrical output signal of sixty pulses per second (pulses per second hereinafter written as "pps") to drive the electronics as will be discussed below. The output from the battery clock is connected at one terminal of the integrated circuit, denoted by the numeral "3". Additionally, there may be input signals at other terminals of the integrated circuit, such as the terminals denoted by the numerals "1", "2", "4", and "5". These latter input signals may be of varying frequencies, such as 1 pps, 30 pps, 9 pps, and 50 pps, respectively. Each input signal is divided in one or more frequency divider networks, denoted by the numeral 22 (see FIG. 2), thereby to provide a repetition frequency of four pulses per hour (pulses per hour hereinafter written as "pph") according to the preferred embodiment of the present invention. The pulses occur at the end of each quarter hour interval.

The output signal of the frequency divider 22 serves as an input signal to a 4-stage ring counter 24 (hereinafter referred to as a "ring counter") to step the ring counter sequentially from one stage to another, then to and through each further stage and then to recycle through the sequence of stages. Each stage to which the ring counter is stepped provides a continuously high input signal to different ones of a plurality of switching circuits identified by the numeral 26. The input signals from the several stages are indicated by the several arrows in FIG. 2. The program of the present invention employs four switching circuits and each is controlled in repetitive sequence during each hour.

The individual switching circuits energized at quarterhour periods determine the staging of the chime ring counter 28 (hereinafter referred to as a "chime counter"). The chime counter, in turn, provides a signal during staging to various gates of a plurality of gates thereby to control the operation of the chime matrix 30 whose output signals are synthesized by an oscillator through a digital gain control circuit, and a frequency synthesizer 32. The make-up and functioning of the chime counter 28, chime matrix 30, digital gain control circuit and frequency synthesizer 32 will be discussed in detail hereinafter.

As indicated, a simulated Westminster chime program is generated at the end of each quarter hour interval. The four different chime programs set out in the following table are illustrated by musical notation and relative time values in FIGS. 10A-10D.

Figure 10A:
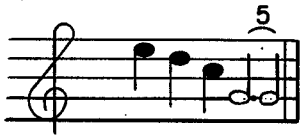
FIGS. 10A–D illustrate in musical notation the notes of the chime programs.
Figure 10B:
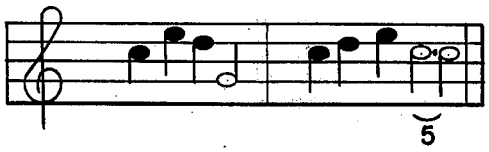
Figure 10C:
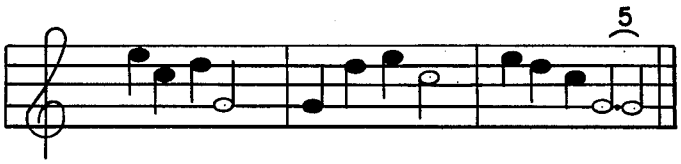
Figure 10D:
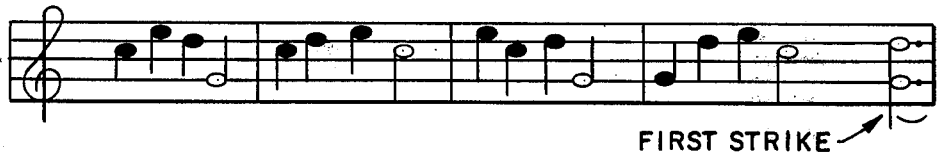

| Time | Chime Program | No. of Strikes |
|---|---|---|
| 12:15 | FIG. 10A | — |
| 12:30 | FIG. 10B | — |
| 12:45 | FIG. 10C | — |
| 1:00 | FIG. 10D | 1 (Fig. 11A) |
| 1:15 | FIG. 10A | — |
| 1:30 | FIG. 10B | — |
| 1:45 | FIG. 10C | — |
| 2:00 | FIG. 10D | 2 |
| 2:15 | FIG. 10A | — |
| 2:30 | FIG. 10B | — |
| 2:45 | FIG. 10C | — |
| 3:00 | FIG. 10D | 3 (Fig. 11B) |
| . | . | . |
| . | . | . |
| . | . | . |
| 10:30 | FIG. 10B | — |
| 10:45 | FIG. 10C | — |
| 11:00 | FIG. 10D | 11 |
| 11:15 | FIG. 10A | — |
| 11:30 | FIG. 10B | — |
| 11:45 | FIG. 10C | — |
| 12:00 | FIG. 10D | 12 |

Tone switching and generating circuitry 34, the audio circuitry, is designed to provide four different fundamental notes, each note having the desired harmonic content, modulated tone, exponential decay and "vibrato effect" thereby to simulate the musical timbre of a conventional strike and chime program of a clock having hammers and tone bars. In the present invention the fundamental tones are $C^1$ (523.25Hz), $D^1$ (587.33Hz), $E^1$ (659.0Hz), and G (392.0Hz). Each tone is obtained by a frequency division from a higher frequency and each tonal frequency preferably should have a fixed relationship within ±0.5%. The stability of the higher frequency preferably should be within ±5% over the voltage range of the power source, $V_{DD}$, and temperature range to be encountered during operation.

The output signal of the audio circuitry comprising a generated chime program after each quarter hour interval and strike program consisting of two notes sounded simultaneously from one to twelve times upon the hour is electrically coupled to the loud speaker 236. The power level of the signal output will have been increased by the output transistor 268 (see FIG. 4) to drive the loud speaker.

Figure 11A:
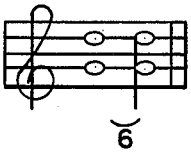
FIGS. 11A and 11B illustrate in musical notation the notes of the strike program.
Figure 11B:
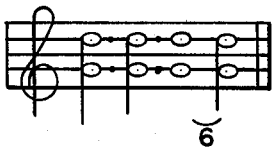

A generated strike program may be seen in FIGS. 11A and 11B. The figures illustrate the strike at one o'clock and three o'clock, respectively. As in FIGS. 10A-10D, the figures illustrate the tone and relative time values in musical notation. Thus, all notes at three o'clock other than the last note, and similarly at hours other than one o'clock have three beats, while the last note has six beats.

Referring again to FIG. 2, the output signal of frequency divider 22 commands the chime counter 28 to step at the rate of an input signal to the chime counter at 1.5 pps through each of several series of chime programs. The programs are of different length and arrangement thereby to be indicative of the particular quarter hour. This operation will become more apparent from the discussion below to be considered in conjunction with FIG. 4.

The ring counter 24, also, provides an output signal of 1 pph to a binary counter 36. Thus, the binary counter is updated each hour by a binary count of one. The counts are accumulated or stored throughout each 12-hour period at which time the binary counter 36 will clear and commence a further accumulation when the next pulse is generated by the ring counter. If, for example, the time is 6 o'clock, the binary counter 36 provides an output signal indicative of a binary six to a comparator 38. To be discussed, pulses from the source at the rate of 1.5 pps to the chime counter are connected through a divider network both to the audio circuits 34 and to a binary counter 40. When the binary counter 40 accumulates a sufficient number of pulses to register a binary six, the comparator, which compares the output signals of the two binary counters, provides an output signal to extend the last note of the strike program. Circuitry is provided to reset the binary counter 40 to binary "zero" after each strike program so that a new comparison may be made at each subsequent hour.

The integrated circuit conveniently may be set to synchronize the strike and chime program with the time of day. This may be accomplished by actuating a reset in the form of a switch button 290 (see FIG. 4). The reset applies a control signal at the reset input of the ring counter 24, binary counter 36 and as will be seen at the reset input of chime counter 28. Thus, the memory of the ring counter is controlled to a stage indicative of the quarter hour period after 12 o'clock whereby the first input signal enables the first switching circuits 26. The input signal is the output signal of 4 pph from the frequency divider 22. At this time, the binary counter 36 is in the cleared condition having an output of binary "zero" and the chime counter is staged such that an input signal will cause it to step through the several stages from stage one. The set, also in the form of a switch button 294 (see FIG. 4), then may be actuated a number of times to advance the counters to a stage indicative of the particular quarter hour period or multiple after 12 o'clock at which the clock hands are located.

If, for example, the hands of the clock are located in the third quarter hour period after 2 o'clock, the set switch button is pressed ten times and pressed for the eleventh time as the minute hand reaches the 45-minute mark. The ring counter will be stepped through eleven stages and the binary counter 36 will have stored two counts. Upon setting, both the ring counter 24 and the binary counter 36 will be properly staged to control the chime counter 28 through the switching circuits for the proper chime program and the audio circuitry for the strike program, respectively.

Figure 4:
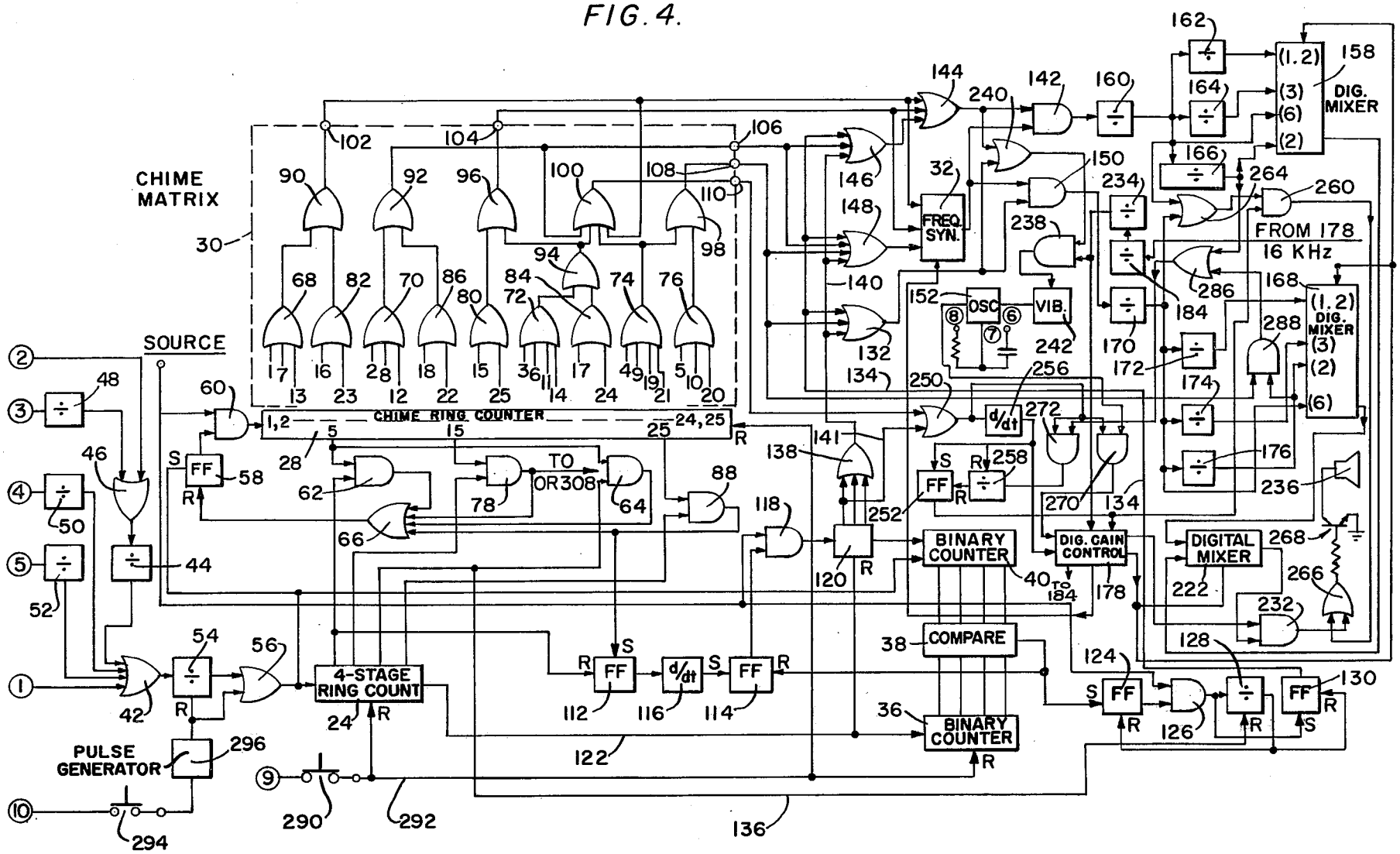
FIG. 4 is a logic circuit diagram illustrating the operation of the circuit.

For a more detailed understanding attention is directed to FIG. 4 and the discussion of the digital logic circuit which follows.

The frequency divider 22 for providing a frequency of 4 pph (1p/15 min.) as an input to the ring counter 24 from the several frequency sources "2", "3", and so forth comprises at least one frequency divider network between the source and one input terminal of OR gate 42. The source of 1 pps is connected directly to a further input terminal of the OR gate.

Particularly, the sources of 30 pps and 60 pps are connected to one input terminal of OR gate 42 through a divide by thirty network 44 at the output of OR gate 46. To this end, the former source is connected directly to one input terminal of OR gate 46, while the latter source is connected to the other input terminal by means of a divide by two network 48. The sources of 9 pps and 50 pps are connected to yet further input terminals of OR gate 42 by means of a divide by nine network 50 and a divide by fifty network 52, respectively.

The output signal of OR gate 42 which derives from any one of the input signals is divided by nine hundred in a divider network 54 and the output signal of reduced frequency is connected to one input terminal of OR gate 56. The output signal of 1p/15 min., as indicated, comprises the input signal to the ring counter 24.

The sources of the several input signals are identified by the numerals 1, 2, 3, 4 and 5. Further input signals may be provided and appropriately divided to serve as an input signal to the divide by nine hundred network 54.

While the input signals may be from any source and in the form of square waves having a suitable pulse width and a positively going amplitude determined by the voltage of the power source, the input signal of 60 pps may be developed from the conventional AC power mains. This input signal is passed through a voltage divider or series resistance to the value of the power source which may be about 1 to about 3 volts.

The output signal from OR gate 56 additionally, is connected to the set input terminal of a set-reset, flip-flop (hereinafter, as each other set-reset flip-flop, referred to as "FF") 58. During a period until reset by a signal at the reset input terminal FF 58 provides a continuous high output signal at one input terminal of AND gate 60. The other input terminal of AND gate 60 is connected directly to the output of multiplier and divider identified as "Source" 54 whose output is 1.5 pps. Thus, at the end of each quarter hour interval the output signal of OR gate 56 enables the AND gate 60 whose output signal of 1.5 pps is connected to the chime counter 28 for purposes of sequence stepping through its several stages. The chime counter may consist of any number of stages determined by the program which is desired. In the form of the invention of FIG. 4 the chime counter includes twenty five stages. Through the operation of the ring counter 24 and switching circuits 26, the chime counter 28 provides four different chime programs of varying length.

For purposes of description of the operation, assume that the ring counter 24 is in the stage of a strike program, then the next output signal from OR gate 56 will recycle the ring counter to the first stage. In this stage, the ring counter will provide a continuous high signal to one input terminal of AND gate 62 included within the first switching circuit. When the chime counter has stepped through each of the first four stages to the fifth stage, it provides an output signal to the other input terminal of AND gate 62 as well as to one input terminal of AND gate 64. Because of the staging of the ring counter 24, there is no signal at the other input terminal of AND gate 64 and no output. The only output signal is derived from AND gate 62. This output signal is connected to one input terminal of OR gate 66 which, in turn, connects the signal to the reset input terminal of FF 58. FF 58 resets, AND gate 60 is disabled and the chime counter stops sequencing at the fifth stage.

The chime counter 28 as it sequences through each of the five stages applies a signal to selected input terminals of a chime matrix 30 which may be formed of an array of OR gates. At the first stage, an output signal is provided at one input terminal of OR gate 68, at the second stage an output signal is provided at one input terminal of OR gate 70, and similarly through the remaining stages of the sequences providing an output signal at one input terminal of OR gates 72, 74 and 76. For convenience, the various input terminals of the OR gates already referred to and to be referred to include numerals which indicate the terminal for each stage of the chime counter. The stages one through five of the chime counter command the four different tones of the chime sequence (see FIG. 10A). The first four stages also command an output signal used for triggering an envelope generator, to be discussed.

The next and each subsequent output signal of OR gate 56 provides a stepping pulse to step the ring counter 24 to a further stage after the interval at the one-half hour, the interval at the three-quarter hour, the interval at the hour and so forth. Each output signal, as described heretofore, is connected also to set input terminal of FF 58. A continuous high output signal is provided, once again, at the firstmentioned input terminal of AND gate 60 and the stepping 1.5 pps output signal of the "Source" steps the chime counter 28 through a further plurality of stages comprising a second sequence.

At the half-hour, the chime counter steps from stage five through fourteen to stage fifteen. The output signal of stage fifteen is connected to one input of AND gate 78. The continuous high input signal from the second stage of the ring counter 24 at the other input terminal enables AND gate 78 and disables AND gate 60 as discussed above.

The output signal from each stage of the chime counter provides an input signal to further input terminals of the OR gates of chime matrix 30. To this end, the sixth stage provides an input signal at another input terminal of OR gate 72, the seventh stage provides an input signal at another input terminal of OR gate 68, the eighth stage provides an input signal at another input terminal of OR gate 70, the ninth stage provides an input signal at another input terminal of OR gate 74, and so on through the tenth to the fifteenth stages at an input terminal of OR gates 76, 72, 70, 68, 72 and 80. In different sequence, like tones are generated over a longer chime program interval.

In a similar manner, the chime counter is activated after a quiescent period to step through a further sequence of stages when the ring counter 24 is stepped by an input signal from OR gate 56 after the three-quarter hour interval and after the hour interval. The chime counter 28, first steps through a sequence of stages from stage fifteen through stage twenty-five and then automatically recycles to stage one for further stepping through stage four to stage five. There is an output signal from the chime counter at both stage twenty-five and stage five. The first output signal is of no effect on the operation of the system because of the staging of the ring counter 24, as was the case with the one-quarter hour staging of the ring counter. However, at stage five the output signal is connected to one terminal of AND gates 62 and 64. Only AND gate 64 is enabled by the continuous high output signal from the ring counter 24 at the other input terminal.

In the manner as described, the stages of the chime counter 28 each provide an output signal at other terminals of the OR gates of the chime matrix both referred to and to be referred to. To this end, the chime counter first provides an input signal at one input terminal of OR gate 82, 84, 86, 74, 76, 74, 86, 82, 84, 80 and then follows the sequence through stage one to stage five.

The final stepping sequence of the chime program occurs upon the hour. At this time, the chime counter steps from stage five through stage twenty-four to stage twenty-five at which time the sequencing is terminated.

Each of AND gates 78, 64 and 88 functions in the manner of AND gate 62 such that upon the presence of simultaneous input signals at the input terminals, one from the chime counter and the other from the ring counter, the particular AND gate provides an output signal to respective ones of the input terminals of OR gate 66, the latter of which provides an input signal at the reset terminal of FF 58 to disable AND gate 60. AND gate 60 will be enabled by the next input signal from OR gate 56 at the commencement of the next sequence.

Referring again to the chime matrix 30 it is seen that OR gates heretofore discussed provide input signals to input terminals of further OR gates which, in turn, either directly or indirectly through additional OR gates are connected to the frequency synthesizer 32 and audio circuitry 34.

Particularly, the output signals of OR gates 68 and 82, respectively, provide the input signals at the respective input terminals of OR gate 90; the output signals of OR gates 70 and 86, respectively, provide the input signals at the respective input terminals of OR gate 92; the output signals of OR gates 80 and both OR gates 72 and 84 through OR gate 94, respectively, to provide the input signals at the respective input terminals of OR gate 96; and the output signals of OR gates 74 and 76, respectively, provide the input signals at the respective input terminals of OR gates 98. OR gate 100 is enabled by the output of any one of OR gates 74, 90, 92 and 94. The output signals of the chime matrix 30 are available at the terminals 102, 104, . . . and 110. The output signals (*e, c, d, g* and *n*) command four tones and a triggering output. The output signals are derived from OR gates 90, 98, 96, 92 and 100, respectively.

Referring now to FIGS. 10A–10D, it will be apparent that the first five input signals to the chime matrix command four different notes $E^1$, $D^1$, $C^1$ and G which occur in the sequence of the chime program of FIG. 10A after the first quarter hour interval. The stepping of the chime counter through five stages permits, as is the case in the chime sequences after the second quarter hour interval, the third quarter hour interval and upon the hour, the last of each series of four notes to be held longer than the other notes of the series because of the absence of a triggering pulse to the envelope generator.

After the half hour interval, the chime counter is stepped through the next ten stages providing the notes of the chime series of FIG. 10B. After the next quarter hour interval, the chime counter is stepped through fifteen stages providing the notes of the chime series of FIG. 10C. And after the next quarter hour interval, upon the hour, the chime ring counter is stepped through twenty stages providing the notes of the chime series of FIG. 10D. The stepping continues after each quarter hour thereafter in the same manner and a strike program is activated upon each hour.

The output signal of AND gate 88 is connected to FF 112 providing an input signal at the set input terminal. The continuous high output signal of FF 112 is connected to the set input terminal of FF 114 through a differentiator 116. The continuous high output signal of FF 114 is connected to one input terminal of AND gate 118. The other input terminal of AND gate 118 is connected directly to the 1.5 pps output signal of the "Source". Upon occurrence of input signals at both terminals the AND gate 118 provides an output signal to the binary counter 40. The output signal of 1.5 pps is divided in a divide by three frequency divider 120 whereby the signal to the binary counter is of a frequency of 1p/2 sec. The pulses to the binary counter 40 are stored cumulatively for purposes of comparison of the binary count of binary counter 40 with the binary count of binary counter 36. When the counts compared are equal, the comparator 38 provides an output signal which functions to terminate the strike program.

The binary counter 40 is reset to binary "zero" by the output signal of OR gate 56 to prevent a storage of pulses and to assure that the comparison with the binary output of binary counter 36 will properly reflect the hour.

The storage of counts in binary counter 36 is cumulative through twelve counts, at which time the binary counter clears to begin a further accumulation. The binary counter 36 reflects a binary count indicative of the number of output signal pulses from the ring counter 24, occurring on the hour, along line 122. The output signal on line 122 also is connected at the reset terminal of frequency divider 120.

The comparator 38 compares the binary count of binary counters 36 and 40 and at such time as there is a comparison provides an output signal to the set terminal of FF 124. The output signal also is connected to the reset terminal of FF 114 with the result that FF 114 reverses its state to disable AND gate 118, not only to terminate the strike program but further accumulation of pulses in binary counter 40.

The differentiator 116 which couples FF 112 and FF 114 permits FF 114 to reset immediately irrespective of the state of FF 112. In this connection, the output signal of comparator 38 will remain high at least until the output signal from the differentiator drops low thereby to assure that FF 114 is reset before a pulse in excess of the number required is gated by the AND gate 118 to the binary counter 40.

The output signal of the ring counter 24 after the quarter hour period provides an input signal at the reset terminal of FF 112. The input signal reverses the state of FF 112. The next and each subsequent input signal from AND gate 88 is applied to the set terminal of FF 112 to permit, once again, counting and comparison, as described.

The continuous high output signal of FF 124 provides an input signal at one input terminal of AND gate 126. The other input terminal is connected directly to the 1.5 pps output signal of the "Source". AND gate 126 having a continuously high signal at one input terminal gates the pulsed signal from the "Source" to the input terminal of a divide by four frequency divider network 128 and to the set terminal of FF 130. The output signal from the frequency divider is connected both to the reset terminal of FF 124 and to the reset terminal of FF 130. The AND gate 126, therefore, gates four pulses at a frequency of 1.5 pps before being disabled by a pulse at the reset terminal of FF 124. For the period of time that AND gate 126 is enabled, i.e., approximately 2.667 seconds, there will be a continuously high signal at one input terminal of OR gate 132 connecting with line 134. This portion of the circuit controls the extended duration of the last note of the strike program which is initiated by the enablement of AND gate 118. The divider network 128 is reset at the three-quarter hour by an output signal from ring counter 24 along line 136.

The divide by three frequency divider 120 of the strike circuit provides a plurality of outputs, each of which is coupled separately to one of three input terminals of OR gate 138. The output signal of OR gate 138 is coupled to the audio circuitry 34 and frequency synthesizer 32 along line 140 for purposes as will become apparent. The output signal along line 140 is comprised of the total of the three input signals having a pulse width of 0.667 seconds and received sequentially at the input terminals of OR gate 138. If the hour to be struck is 1 o'clock, the output signal along line 140 will be of 2 second duration.

There are five output signals obtained from the chime matrix 30 in response to the output signals of the chime counter 28 as it steps through each series of stages. The outputs, as indicated, are located at points 102, 104 . . . 110 designated further as outputs *e, c, d, g* and *n*. In the chime program which is generated by the chime matrix the output signal *n* may be obtained concurrently with any other output signal, the latter all being obtained sequentially. The sequence may, however, vary as is evident from FIGS. 10A–10D. The several output signals control the frequency synthesizer 32 and the audio circuits 34 now to be discussed.

The output signals *e, c* and *d* from the chime matrix at points 102, 104 and 106 representing a portion of the chime program of FIG. 10A are applied to the respective input terminals of the frequency synthesizer 32 and ultimately to a chain of binary counters with gate-selectable resets to provide various different frequencies. The terminals of the frequency synthesizer, although not labelled in FIG. 4, from top to bottom are the terminals *e, c, d* and/or *g*, respectively.

Particularly, the output signals *e* and *c* are connected to one input terminal of AND gate 142 through OR gate 144 and to the other input terminal of AND gate 142 through the frequency synthesizer 32. The output signal *e* is connected to the *e* input terminal of the frequency synthesizer while the output signal *c* is connected to the *c* input terminal. The output signal *d* is also connected to the first mentioned input terminal of AND gate 142 through OR gate 146 and OR gate 144 as well as to the second mentioned input terminal of AND gate 142 through OR gate 148 and frequency synthesizer 32. The output signal *d* is connected to the *d* input terminal of the frequency synthesizer. The *d* input terminal of the frequency synthesizer is also used to generate the G tone. In the generation of the $E^1$, $C^1$ and $D^1$ tones there is an output signal to one input of AND gate 150 which is not enabled because of the absence of a signal at the other input terminal.

In the present embodiment, an oscillator 152 drives the frequency synthesizer 32. The oscillator is electrically connected to a resistance 154 (R1 at terminal 8) and a capacitance 156 (C1 at terminal 6), respectively, and may oscillate at a frequency of 2 MHz. This frequency is modulated, as will be described, and the drive to the frequency synthesizer is through a digital gain control 178.

The frequency synthesizer 32 provides output frequencies which correspond to the input signal from the chime matrix 30, which output frequencies are twelve times the fundamental tones of $C^1$, $D^1$ and $E^1$. Each output frequency will be passed to the aforementioned counter through the period during which AND gates 142 and 150 are enabled, namely, 0.667 seconds, approximately.

The fundamental tones are:

$C^1$ — 523.25 Hz
$D^1$ — 587.33 Hz
$E^1$ — 659.0 Hz

The output signal of AND gate 142 which is at a frequency twelve times that of the fundamental tones of any one of $D^1$, $E^1$ and $C^1$, divided as will be discussed, is connected to a digital mixer 158 (hereinafter "Mixer #1"). Mixer #1 has four inputs, the frequency of each being developed through different divider networks. Indicia, in parenthesis, of the multiple of the fundamental tone of $D^1$, $E^1$ and $C^1$ may be seen in the figure. The several inputs may be developed, as follows: the input at 1.2 times the fundamental tone is determined by frequency divider networks 160 and 162 (a divide by two and a divide by five network); the input at 3 times the fundamental tone is determined by the frequency divider network 160 and frequency divider network 164 (also a divide by two network); the input at 6 times the fundamental tone is determined by frequency divider network 160; and, the input at 2 times the fundamental tone is determined by frequency divider network 160 and frequency divider network 166 (a divide by three network).

The fundamental frequency of G (392.0 Hz), being approximately two-thirds that of the fundamental frequency of $D^1$, need not be provided by the frequency synthesizer 32. As will be discussed, the arrangement of further frequency divider networks provides the G output when it is called for by the appropriate stepped staging of the chime ring counter 28 and the *g* output signal of the chime matrix 30. This output signal from the chime matrix is connected to the frequency synthesizer 32 at the *d* input terminal and to a second input terminal of OR gate 132. The output signal of OR gate 132 and the output signal of frequency synthesizer 32 at twelve times the fundamental frequency of $D^1$ (about 7048 Hz) provides the required input signals at the input terminals of AND gate 150 to enable the gate. The output signal of AND gate 150, divided as will be discussed, is connected to a digital mixer 168 (hereinafter "Mixer #2"). Mixer #2 similarly has four inputs, the frequency of each being developed through different divider networks. Again, indicia in parenthesis of the multiple of the fundamental tone of G may be seen in the figure. The several inputs may be developed as follows: the input at 1.2 times the fundamental tone is determined by frequency divider networks 170 and 172 (a divide by three and a divide by five network); the input at 6 times the fundamental tone is determined by the frequency divider network 170; the input at the 3 times the fundamental tone is determined by frequency divider network 170 and frequency divider network 174 (a divide by two network); and, the input at the 2 times the fundamental tone is determined by frequency divider network 170 and frequency divider network 176 (also a divide by three network).

Thus, the signals employed, to generate any note $E^1$, $D^1$, $C^1$ or G are 1.2 ($D^1$, $C^1$, $E^1$ or G) of the fundamental frequency, and the 2nd harmonic, the 3rd harmonic and the 6th harmonic of the same. As will be discussed, these harmonics are mixed digitally and gated through the digital gain control 178 (decrement generator) to produce any of the four notes. The use of the harmonics of the note results in a simulated bass effect. As will also be discussed, impact is introduced in the beginning of each note for a short duration of time, of about 3 to about 5 milliseconds. The impact simulates the sound of a hammer hitting the bar of a mechanically sounded tone.

As was heretofore set out in connection with AND gate 150, AND gate 142 is not enabled during this period because of the absence of a signal at the first-mentioned input terminal.

Figure 6:
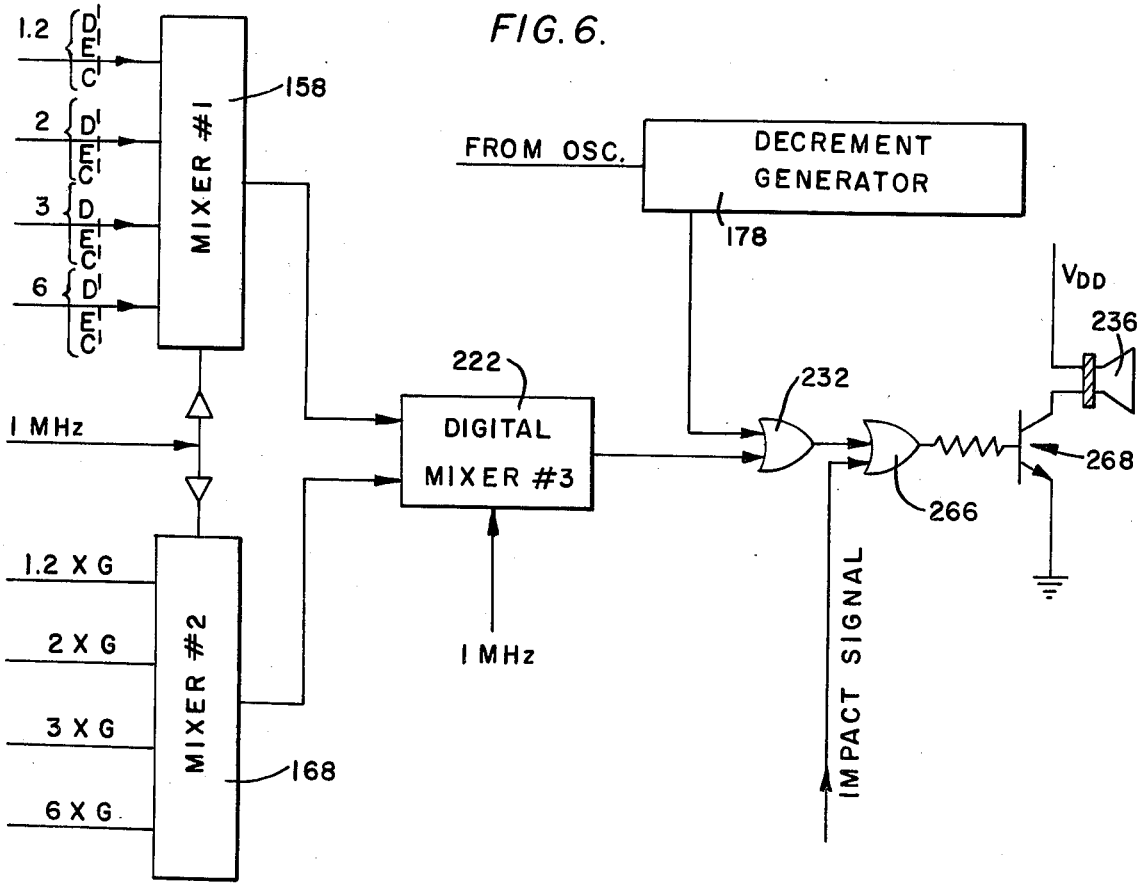
FIG. 6 is a diagram of the strike and chime portion of the circuit of FIG. 4.

Referring now to FIGS. 6–8 the various input signals to Mixer #1 and Mixer #2 including that of the multiple of the fundamental frequency and the harmonics are connected to an input terminal of individual AND gates. A 1 MHz signal output which is continuous during operation of the digital gain control 178 is connected to the other input terminal of each AND gate through a ring counter 180, 182, which, when power is "on", rings at a high frequency continuously and a plurality of OR gates to be described. A 16 KHz signal output of the digital gain control is connected to a divider network 184.

The 1 MHz signal input from the digital gain control 178 steps the ring counter 180 through its several stages, each stage providing an output signal at one of the input terminals of OR gates 186, 188, 190 and 192. The output signal of each OR gate, as mentioned, constitutes the input signal at the other input terminals of AND gates 194, 196, 198 and 200. In this manner, the multiple of the fundamental frequency and the harmonics of the tones $C^1$, $C^1$ and $E^1$ are mixed. The output of Mixer #1 is derived from OR gate 202, the input terminals of which are connected to the several AND gates 194, etc.

The Mixer #2, including OR gates 204, 206 . . . and 212, as well as AND gates 214, 216, 218 and 220, has smaller operation in the mixing of the multiple of the fundamental frequency and the harmonics of the tone G.

The outputs of Mixer #1 and Mixer #2 are connected to a digital mixer 222 (hereinafter "Mixer #3"). To this end, the output of Mixer #1 is connected to one input terminal of AND gate 224, while the output of Mixer #2 is connected to one input terminal of AND gate 226. A ring counter 228 is staged by the 1 MHz input signal from the digital gain control 178 providing the input at the other input terminals of AND gates 224 and 226. The output of Mixer #3 is the output of OR gate 230 which is controlled by the aforementioned AND gates. The output is connected to one input terminal of AND gate 232. The Mixers #1, #2, and #3 operate on the principle of time division multiplexing. Thus, the 6th harmonic, 3rd harmonic, 2nd harmonic and the multiple (1.2) of the fundamental frequency are mixed in the ratio 2:2:3:3. The 6th harmonic, 3rd harmonic, 2nd harmonic and the multiple of fundamental frequency are gated digitally 2 unit time: 2 unit time: 3 unit time: 3 unit time. The unit time selected, one micro second, is above the audio range so that the gating frequency beats are not recognized. Digital mixing provides a good quality of sound in that it is highly immune to noise signals. And the human ear and the output speaker 236 integrate the mixed harmonics and the multiple of fundamental frequency as if mixed in an analog manner.

Mixer #3 operates in a similar manner.

The divider network 184 (providing a countdown of $2^7$), whose output is approximately 125 Hz, is connected to a second divider network 234 (providing a countdown of $2^4$). The signal output of network 234, in the range approximately of 7.81 Hz, is connected to the digital gain control 178. The output signal, also, is connected to one input terminal of AND gate 238. The signal to the other input terminal is from OR gate 240 which is enabled by an output from chime matrix 30 and AND gate 118 during a chime and strike program.

The output signal of AND gate 238 is connected to a vibrato circuit 242 and to oscillator 152 to modulate its output frequency and thereby modulate the tone of the various notes generated during a strike and chime program.

Figure 5:
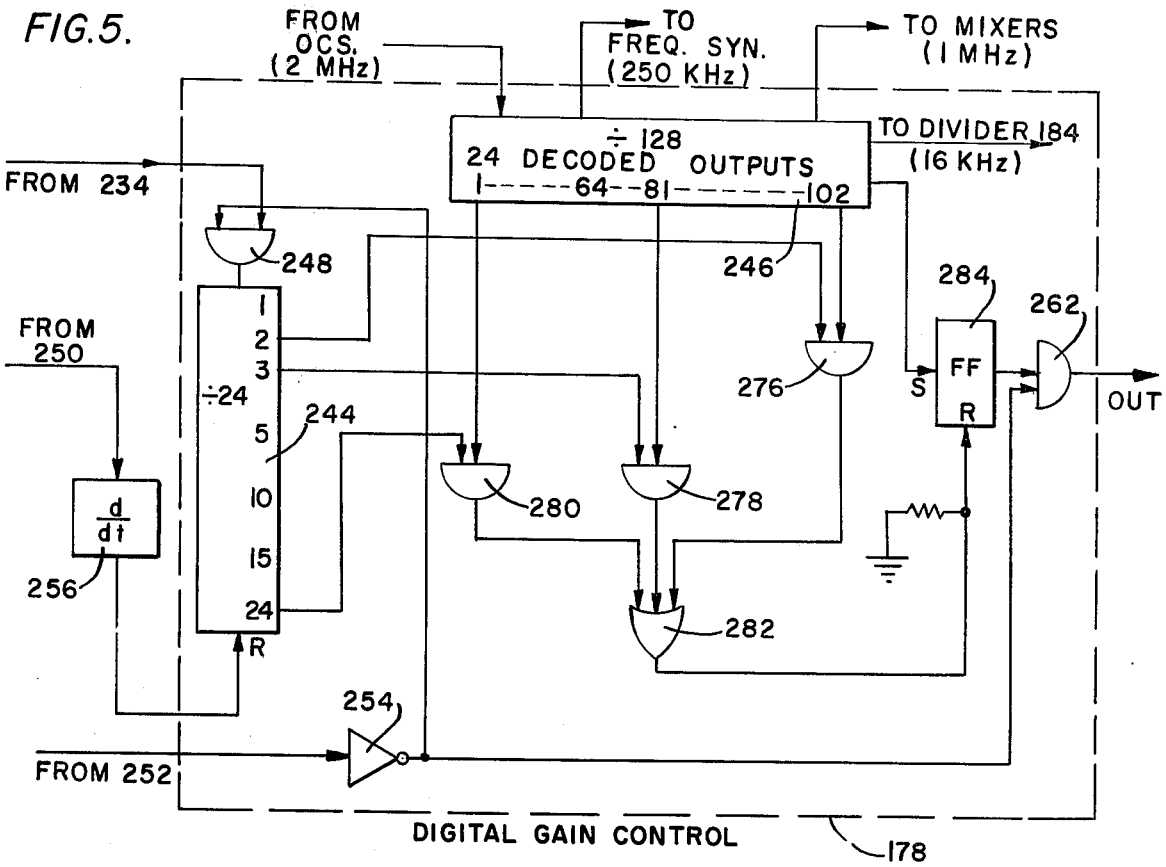
FIG. 5 is a diagram of the digital gain control portion of the circuit of FIG. 4.

The structure of the digital gain control 178 may be seen to best advantage in FIG. 5. There are a plurality of inputs to the digital gain control, an output signal to the other terminal of AND gate 232 and a plurality of frequency controls, such as the 1 MHz signal to Mixers #1, 2 and 3, a 16 KHz signal to divider 184 and an approximate 250 KHz signal to the frequency synthesizer 32. The digital gain control includes a pair of frequency divider networks, one being a divide by twenty-four network 244 and the other a divide by one hundred twenty-eight network 246. The latter is controlled by the modulated output of oscillator 152. The former network is controlled by the output signal of AND gate 248. The AND gate has two input terminals; a first of which is connected to the output of frequency divider 234, the second of which is connected to FF 252 through an inverter 254. The reset terminal of the divider network 244 is also connected to OR gate 250 through a differentiator network 256. Thus, a signal from the output terminal 110 of the chime matrix 30 resets the divider network 244 each time that an envelope request is made.

FF 252 together with differentiator 256 and a divide by four network 258 comprise the impact circuit. The impact circuit develops a pulse of a duration of from about 3 to about 5 msec. in duration at the beginning of each note. The impact pulse which is connected to one input terminal of AND gate 260 also disables the AND gate 248 and AND gate 262, at the output of digital gain control 178, because of the operation of the inverter 254. At all other times the input signal at the respective input terminals of AND gates 248 and 262 will be high.

OR gate 264 provides an input to the other input terminal of AND gate 260. OR gate 264 is enabled by the output of either frequency divider 160 or frequency divider 170, each being the 6th harmonic of the fundamental tone of notes $C^1$, $D^1$, $E^1$ and G, respectively. The output of AND gate 260 enables OR gate 266 during the impact period. Thereafter, and during the period of sounding of each note, OR gate 266 will be enabled by AND gate 232 to energize the output speaker 236 by operation of transistor 268.

Referring again to FIG. 4, the modulated output of oscillator 152 is connected to one input terminal of AND gate 270. The AND gate is enabled both by the output from the chime matrix 30 (output *n*) and AND gate 118, both through OR gate 250. The AND gate 272 is enabled in the same manner and supplies an input frequency signal to the divider network 258. The signal at other input terminal of AND gate 272 derives from OR gate 286, as will be described.

As may be appreciated, AND gate 270 will be enabled during the period of each output signal from the chime matrix 30 and during the active strike program as determined by AND gate 118 and the divide by three frequency divider 120.

The digital gain control 178 includes a plurality of AND gates 276, 278 and 280, each of which has one terminal connected to the divide by twenty-four network 244, as illustrated. The other terminals are connected to the divide by one hundred twenty-eight network 246, as illustrated, and each AND gate being enabled provides an output to OR gate 282. OR gate 282 is connected to the reset terminal of FF 284. The set terminal is connected to the divide by one hundred twenty-eight divider 246. The digital gain control utilizes the principle of duty cycle variation. In the generation of an exponential envelope the pulse width of the gating pulse is varied from 64 microseconds to 0.5 microseconds in twenty-four steps of 2 db at an approximate step duration of 200 ms. Thus, a signal from the chime matrix 30 resets the divide by twenty-four network 244 every time an envelope request is made by chime matrix. After the impact period, the first 200 msec. pulse is passed to the network and FF 284 is set. The output of the digital gain control is 100% duty cycle. During the second 200 msec. pulse, FF 284 is set every 64th unit time and reset every 51st unit time through additional AND gates similar to AND gates 276, 278 and 280. The duty cycle is then in the ratio of 51/64 and approximately 2 db down in power. During subsequent 200 msec. pulses, the duty cycle is reduced by the same ratio. During the 24th step, the power of the digital gain control will be approximately 48db down in comparison with the power initially.

Returning to FIG. 4, AND gate 272 is connected to OR gate 286 which, in turn, is connected to the output of AND gate 288 and the output of divide by three networks 166 (the 2nd harmonic of $C^1$, $D^1$ and $E^1$). AND gate 288 includes a pair of input terminals, one of which is connected to the output of divide by three network 176 (the 2nd harmonic of G) and the other of which is connected to terminal 108 (g) of chime matrix 30.

All tones of the chime program are initiated at the rate of 1.5 pps. To this end, the output signal from terminal 110 (output *n*) of the chime matrix 30 which can occur concurrently with any of the other outputs from terminals 102, 104, 106 and 108 (outputs *e, c, d,* and *g*) is connected to the digital gain control 178 thereby to generate an envelope. During a strike sequence the output signal on line 141, i.e., 1p/2 sec., deriving from one of the three lines between the divide network 120 and OR gate 138 is applied to the digital gain control through OR gate 250. The output is derived from the divide by three frequency divider 120 to initiate the tones $D^1$ and G simultaneously yet at a slower rate.

The notes D′, E′ and C′ are generated through circuitry connected at the output of AND gate 142 which is enabled by the output of the frequency synthesizer 32 and the output of OR gate 144. During a chime sequence, these notes including the note G may not be obtained simultaneously. However, as will be set out, during a strike sequence the notes G and D′ may be obtained simultaneously. These output signals are connected to the *d* input terminals of frequency synthesizer 32 through OR gate 148. The output of the frequency synthesizer is a square wave at twelve times the fundamental frequency of $D^1$. The output may provide the notes $D^1$ and G simultaneously if there is an input signal at all input terminals of AND gates 142 and 150. AND gates 142 and 150 will be so enabled by the output signal upon lines 134 and 140 through OR gates 132, 144, 146, and 148, the latter being connected to frequency synthesizer 32. The design of the gate circuits prevents other notes or other combinations of notes from occurring simultaneously.

As generally discussed, the system may be set at any time for the desired chime and strike program. To this end, the reset button or switch 290 (terminal 9) is momentarily closed to reset each of the ring counter 24, the chime counter 28, and the binary counter 36. A reset signal is provided on line 292. Other components are reset as has been described. The system now may be set by set button or switch 294 (terminal 10). Closure of the set switch energizes a pulse generator 296 which develops a pulses output signal to the ring counter 24 through the OR gate 56. One pulse is developed upon each switch activation to step the ring counter and after a closure to step the ring counter through the proper quarter hour interval or four steps of the ring counter. The ring counter provides an output to the binary counter which stores one count. The first pulse also resets the divider network 54.

Figure 3:
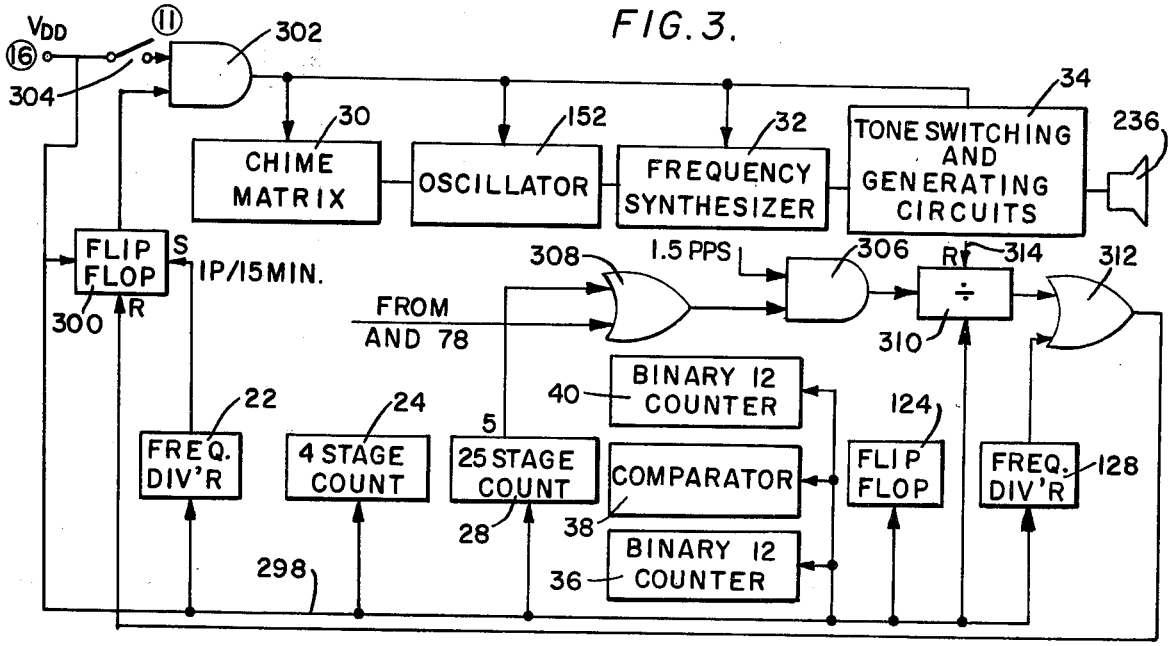
FIG. 3 is a block diagram of the power-down circuitry of the present invention.

To conserve energy, the electronic circuit may be powered down in part after each quarter hour chime program, reenergized at commencement of the next quarter hour chime program, and powered down once again, the sequence being repeated over and over again. FIG. 3 illustrates in block diagram form the manner by which the operation is accomplished. The figure illustrates certain components described above which are supplied with power at all times along lines 298, and other components as are required to switch power "on" and "off".

Power from source $V_{DD}$ which may be a battery source of from 1 to about 3 volts is gated to each of the chime matrix 30, the oscillator 152, frequency synthesizer 32 and the tone audio circuits 34 when a continuous high input signal form FF 300 is received at one input terminal of AND gage 302. Otherwise, these circuits are isolated from the power source which is connected directly to the other input terminals through the switch 304. Each output signal at the rate of 1p/15 min. from the frequency divider 22 provides an output signal at the set input terminal of FF 300 to provide an output signal to the AND gate 302. At the end of each of the three chime programs at the quarter hour marks, an output signal from the respective stages of the chime counter once again is gated to one input terminal of an AND gate 306 through an OR gate 308. A signal of 1.5 pps is connected directly at the other input terminal of AND gate 306. A divide by four frequency divider 310 provides an output signal at the appropriate time to the reset input terminal of FF 300 through the OR gate 312 to power down the circuit. Upon the hour, the circuit is powered down by a signal from divider network 128 through OR gate 312. A signal from OR gate 56 provides a reset signal at terminal 314 of the divide by four frequency divider 310 upon each one quarter hour. FF 124 and the divide by four frequency divider 128 have been discussed heretofore. These components operate to power down the circuit after a chime program.

The switch 304 may be opened if the operator desires to silence the chime and strike program without affecting the memory of the electronics.

The summarized operation thereby to develop the last two notes of the chime program of FIG. 10D and the strike program of FIG. 11A now will be discussed. Thus, the chime counter 28 will have stepped to stage twenty-four, thereby to provide an output signal of 0.667 seconds duration at terminals 104 and 110. The former output signal enables AND gates 142 which through the period of the output signal, i.e., approximately 0.667 seconds, gates the multiple of the fundamental tone of $C^1$ (6279Hz) developed by frequency synthesizer 32 to the mixer 158 (Mixer #1). By frequency division, each of the 1.2 multiple and the 2nd, 3rd, and 6th harmonics of the fundamental tone of $C^1$ are connected at the several intput terminals of the mixer. The inputs signals to Mixer #1 are mixed through multiplexing and an output signal is connected to the mixer 222 (Mixer #3). The Mixer #3 and its output signal is connected to one input terminal of AND gate 232.

The frequency synthesizer 32 is driven by oscillator 152 which provides a modulated 2MHz output signal to a digital gain control 178 when the circuit is powered, as during a chime and strike sequence. To this end, the digital gain control develops an approximate 250 KHz output signal which is directly connected to the frequency synthesizer 32 for development of the various multiples of the fundamental tones, such as $C^1$.

The output signal of the oscillator 152 is connected to one input terminal of AND gate 270, then to the digital gain control 178. AND gate 270 is enabled by the output signal at terminal 110 which is gated through OR gate 250.

There are further input signals to the digital gain control during the period of the output signals generated by the chime matrix 30 at the twenty-fourth stage of the chime counter 28. These inputs signals include an approximate 8 Hz signal developed by the frequency divider networks 184 and 234 and an input signal of about 3 to about 5 millisecond pulse duration. Because of the operation of the inverter 254 at the input, the digital gain control connecting with one input terminal of the AND gate 262 is incapable of providing an output signal to the other input terminal of AND gate 232 during the duration of the pulse. As set out heretofore, the digital gain control functions on the principle of duty cycle variation in the generation of an exponential envelope for the fundamental tone $C^1$ sounded by the speaker 236.

The approximate 8 Hz input signal to the digital gain control also modulates the oscillator through the vibrato network 242 which is enabled by AND gate 238. To this end, the input terminals of the AND gate are connected to the frequency dividers and to OR gate 240 which is enabled by the chime matrix 30.

The signal of about 3 to about 5 milliseconds pulse duration is developed by FF 252 which is set by differentiator 256 and reset by a divider network 258. The FF 252 is connected to one input terminal of AND gate 260 which is enabled by the output signal of either frequency divider network 160 or frequency divider network 170 which is gated by OR gate 264. The former frequency divider enables the AND gate, upon generation of the fundamental tones $C^1$, $D^1$ and $E^1$, while the latter frequency divider enables the AND gate upon generation of the fundamental tone G. This is the impact circuit which passes the 6th harmonic of the respective fundamental tone to speaker 236 during the duration of the pulse. As indicated, the impact circuit serves to simulate the sound of a hammer hitting a bar in the mechanical chimes. Thereafter, the multiplexed fundamental tone is passed to the speaker by enablement of AND gate 232 through operation of the digital gain control.

AND gate 272 having one input terminal connnected to OR gate 250 is enabled by the output of OR gate 286 thereby to provide an input frequency signal to the divider network 258. The OR gate 286 is enabled either by the second harmonic of the fundamental tone of $C^1$, $D^1$ and $E^1$ or G.

The last note of the chime sequence at 1 o'clock is generated when the chime counter is stepped to stage twenty-four. The output signal is at terminal 104, only. The digital gain control is powered by the modulated output of the oscillator 152 and a continuous output is connected to AND gate 232 through FF 284 and AND gate 262.

When the chime counter is stepped to stage twenty-five AND gate 88 is enabled, thereby to enable AND gate 118. As indicated, the binary counter 36 has sequenced and stored a single count through operation of ring counter 24 at the beginning of each hour chime sequence. The frequency divider network 120 functions to pass 1p/2 sec. to update binary counter 40 to count one which is compared by comparator 38. The frequency divider network 120 is a divide by three divider and functions to provide sequential outputs to OR gate 138 so that a pulse of two seconds duration is connected to OR gates 132, 146 and 148 along line 140. A 1p/2 sec. pulse also is connected to OR gate 250.

The pulse along line 140 enables AND gates 142 and 150 which gates the twelve times multiple of the fundamental tone of $D^1$ simultaneously to mixer 158 Mixer #1) and the mixer 168 (Mixer #2) through selected frequency divider networks to develop the 1.2 multiple and each of the 2nd, 3rd, and 6th harmonics of $D^1$ and G.

The 1p/2 sec. signal at one input terminal of OR gate 250 as well as the other inputs to the digital gain control provide the operation heretofore described. Also, as described, the oscillator 152 is modulated and the impact circuit is operative. When the comparison of the count of binary counters 36 and 40 is made AND gate 126 sets FF 130 which, prior to resetting, provides an output signal of approximately 2.667 seconds duration on line 134 to respective input terminals of OR gates 132, 146 and 148. The $D^1$ and G notes continue to be generated without exponential decay through operation of the digital gain control.

The system next is reset and the sequence of operation resumes at the next one-quarter hour interval.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. An electronic strike and chime generating system and the like comprising in combination:

a. means commanding a chime program comprising a plurality of notes in ordered sequence;

b. means activating said chime program commanding means upon at least each hour interval;

c. means commanding a strike program, said strike program commanding means activated upon each said hour interval after completion of said chime program;

d. frequency synthesizer means;

e. means electrically connecting said frequency synthesizer both to said strike and chime program commanding means for response to the same thereby providing a plurality of outputs each comprising a multiple of the frequency of the fundamental tone of at least some of said notes of said programs;

f. means for generating the fundamental frequency with selected harmonics of all notes of said programs;

g. a loud speaker responsive to said generating means for sounding said programs; and h. means electrically connecting said loud speaker and said generating means.

2. The system of claim 1 wherein said activating means activates said chime program commanding means after each one-quarter hour interval to command a chime program which is distinctive for each said one-quarter hour intervals, and wherein said system includes switching means for terminating each chime program of ordered sequence.

3. The system of claim 2 wherein said chime program commanding means includes a logic circuit comprising an array of logic gates.

4. The system of claim 2 wherein said activating means includes chime counter means having a plurality of stages, the output of each stage connected to one of a plurality of logic gates arranged in an array,, gating means connecting a source of stepping pulses to said chime counter means thereby to step said chime counter means at a pre-determined rate from one stage to the next, and wherein said switching means includes a plurality of logic gates, one input of each of said logic gates connected to individual ones of said stages, and control means connected to the other input of said logic gates to enable the same, an output from each logic gate in response to its enabling inputs disabling said gating means to discontinue said stepping pulses to said chime counter means.

5. The system of claim 4 including means for generating a repetition frequency of 1p/15 min., a set-reset flip-flop connected to said generator means at a set terminal, said set-reset flip-flop being set by each pulse of said repetition frequency, said set-reset flip-flop enabling said gating means when set and disabling said gating means when reset, said set-reset flip-flop being reset by said output from respective ones of said logic gates at a reset terminal.

6. The system of claim 2 wherein said switching means includes control means having a plurality of outputs, means for generating a repetition frequency of 1p/15 min., said control means formed by a ring counter, a plurality of logic gates, said logic gates being controlled sequentially by individual ones of said outputs commencing at each one-quarter hour interval and by said activating means, and first binary counter means, said binary counter means connected to an output of said ring counter means and updated by a binary count of one after each hour interval.

7. The system of claim 6 wherein said means commanding said strike program includes a strike logic gate, a source of stepping pulses connected to said strike logic gate and means responsive to the output of one of said sequentially controlled logic gates of said switching means thereby to enable said strike logic gate to pass said stepping pulses for generation of said strike program.

8. The system of claim 7 including second binary counter means for accumulating a count, means connecting said second binary counter means and said strike logic gate, and a comparator, said connecting means functioning until said count in said second binary counter means compares with said count in said first binary counter means to pass one or more updating count pulses at which time an output of said comparator disables said strike logic gate.

9. The system of claim 8 including means for extending the last strike of said strike program, said extending means connected to said comparator output and to said frequency synthesizer.

10. The system of claim 2 wherein said means connecting said loud speaker and said generating means includes a gain control circuit, and said system further including an oscillator for generating a high frequency signal, and said gain control being activated by said oscillator and, in turn, connecting said oscillator and frequency synthesizer.

11. The system of claim 10 wherein said means connecting said loud speaker and said generating means includes a first digital mixer for multiplexing said fundamental frequency and selected harmonics of some of said notes of said programs, a second digital mixer for multiplexing said fundamental frequency and selected harmonics of the remaining of said notes of said programs, and a third digital mixer, said third digital mixer connected at the output of said first and second digital mixers thereby to provide an output indicative of one or the other or a selected combination of outputs of said first and second digital mixers.

12. The system of claim 11 wherein each of said digital mixers is driven by said gain control.

13. The system of claim 11 wherein said means connecting said loud speaker and said generating means further includes an output AND gate, one input terminal of said output AND gate connected to the output of said third digital mixer, and the other input terminal connected to and said output AND gate enabled by an output of said gain control.

14. The system of claim 13 including means for disabling said output AND gate during at least some of the period of generation of notes of said chime and strike program when there shall be an output from said third digital mixer, said output AND gate being disabled for a duration of time less than about 3 to about 5 milliseconds at the commencement of said notes, and means connecting only a single one of said generated harmonics to said loud speaker for said duration of time to simulate impact.

15. The system of claim 14 wherein said disabling means includes means for generating an impact signal having said time duration, and wherein said means connecting said single one of said generated harmonics includes an impact AND gate, said generated impact signal enabling said impact AND gate and disabling said output of said gain control.

16. The system of claim 8 wherein said means connecting said second binary counter means and said strike logic gate includes a divider network having a plurality of sequentially present output signals, a gain control for attenuating over a period of time at least some of the notes of said strike and chime program, oscillator means for driving said gain control, and means including an attenuation logic gate connecting said chime program commanding means and one of said sequential signals to said gain control.

17. The system of claim 16 wherein said gain control attenuates said notes by duty cycle variation.

* * * * *

UNITED STATES PATENT AND TRADEMARK OFFICE

CERTIFICATE OF CORRECTION

PATENT NO. : 4,073,133

DATED : February 14, 1978

INVENTOR(S) : David E. Earls, et al

It is certified that error appears in the above—identified patent and that said Letters Patent is hereby corrected as shown below:

Col. 4, line 29, after "first" (2nd occurrence) insert --of--.

Col. 5, line 39, "the" should be deleted;
line 63, "formed of" should read --formed by--;
line 68, "sequences" should read --sequence--.

Col. 7, line 30, "gates" should read --gate--.

Col. 13, line 28, "networks" should read --network--;
line 47, "notes D', E' and C'," should read --notes $D^1$, $E^1$ and $C^1$,--;
line 53, after "and", "D'" should be --$D^1$--;
line 54, after "simultaneously.", include as a new paragraph --When a strike program is to be initiated, an output signal from AND gates 118 and 126 is provided on lines 140 and 124, respectively.--.

Col. 14, line 8, "pulses" should read --pulsed--;
line 10, delete "activation to . . . and after a"
line 12, after "interval" delete --or-- and insert --as the binary counter stores one count for each--
line 13, delete the line in its entirety;
line 14, delete "counter which stores one count.";
line 32, "gage" should read --gate--;

UNITED STATES PATENT AND TRADEMARK OFFICE

CERTIFICATE OF CORRECTION

PATENT NO. : 4,073,133

DATED : February 14, 1978

INVENTOR(S) : David E. Earls, et al

It is certified that error appears in the above—identified patent and that said Letters Patent is hereby corrected as shown below:

Col. 14, line 34, "terminals" should read --terminal--;
line 64, "gates" should read --gate--.

Col. 15, line 3, "intput" should read --input--;
line 4, "inputs" should read --input--;
line 25, "inputs" should read --input--.

Col. 16, line 24, insert --(-- before "Mixer".

Signed and Sealed this

*Eighteenth* Day of *March 1980*

[SEAL]

*Attest:*

SIDNEY A. DIAMOND

*Attesting Officer* *Commissioner of Patents and Trademarks*